United States Patent [19]

Morel

[11] 4,160,318

[45] Jul. 10, 1979

[54] APPARATUS FOR SEVERING PREDETERMINED LENGTHS FROM CIGARETTES OR CIGARS

[76] Inventor: Richard E. Morel, 295 Silver St., Greenfield, Mass. 01301

[21] Appl. No.: 876,533

[22] Filed: Feb. 9, 1978

[51] Int. Cl.[2] ..... A24C 5/12

[52] U.S. Cl. ..... 30/113; 131/248; 83/468

[58] Field of Search ..... 131/248–252, 131/233; 83/468; 30/109, 111, 113

[56] References Cited

U.S. PATENT DOCUMENTS

| | | | |
|---|---|---|---|
| 846,650 | 3/1907 | Ellis | 83/468 |
| 1,067,327 | 7/1913 | Fearson | 83/468 X |
| 2,521,854 | 9/1950 | King | 30/109 |

*Primary Examiner*—Stephen C. Pellegrino

*Attorney, Agent, or Firm*—Chapin, Neal & Dempsey

[57] ABSTRACT

An apparatus for severing predetermined lengths from a cigarette or cigar comprises a tubular passage which receives the cigarette or cigar to be cut, and a manually actuated blade positioned transverse to the longitudinal axis of the tubular passage and receivable therewithin for cutting the cigarette or cigar. The length of the cigarette or cigar receivable within the passage and severable by the blade may be varied by selectively positioning an adjustable end wall of the tubular passage.

3 Claims, 4 Drawing Figures

APPARATUS FOR SEVERING PREDETERMINED LENGTHS FROM CIGARETTES OR CIGARS

BACKGROUND

A popular awareness of the possible harmful effects of tobacco smoking has given rise to various methods which when followed aid one in reducing the amount of tobacco habitually consumed. One of such methods recognizes that a gradual reduction in the amount of tobacco consumed is often preferable over a sharp reduction in tobacco consumption. It has also been recognized that a reduction in the consumption of tobacco by a user thereof is often more easily achieved by a reduction in the amount of tobacco consumed at a single time rather than by decreasing the frequency at which the tobacco is consumed. Thus, it is proposed that a method for reducing the consumption of tobacco over a period of time, by severing increasing selected lengths from cigarettes or cigars consumed by the user would meet with considerable success.

Devices such as those disclosed In U.S. Pats. No. 4,027,682 to Halmaghi and No. 1,908,890 to Burns provide means for the extinguishment of a cigarette or cigar by the severing of portions of the cigarettes or cigars from the main bodies thereof, but include no means by which portions of varying selected length may be conveniently and accurately severed from a cigarette or cigar.

Accordingly, it is an object of the present invention to provide an apparatus for accurately severing predetermined lengths from a cigarette or cigar.

It is another object of the present invention to provide such an apparatus wherein the amount severed from the cigarette or cigar by the device is readily adjusted.

It is another object of the present invention to provide such an apparatus which is economical to produce and convenient to use.

DESCRIPTION OF THE DRAWINGS

These and other objects will become more readily apparent from the following detailed description taken in connection with the accompanying drawings in which.

DETAILED DESCRIPTION

Figure 1:
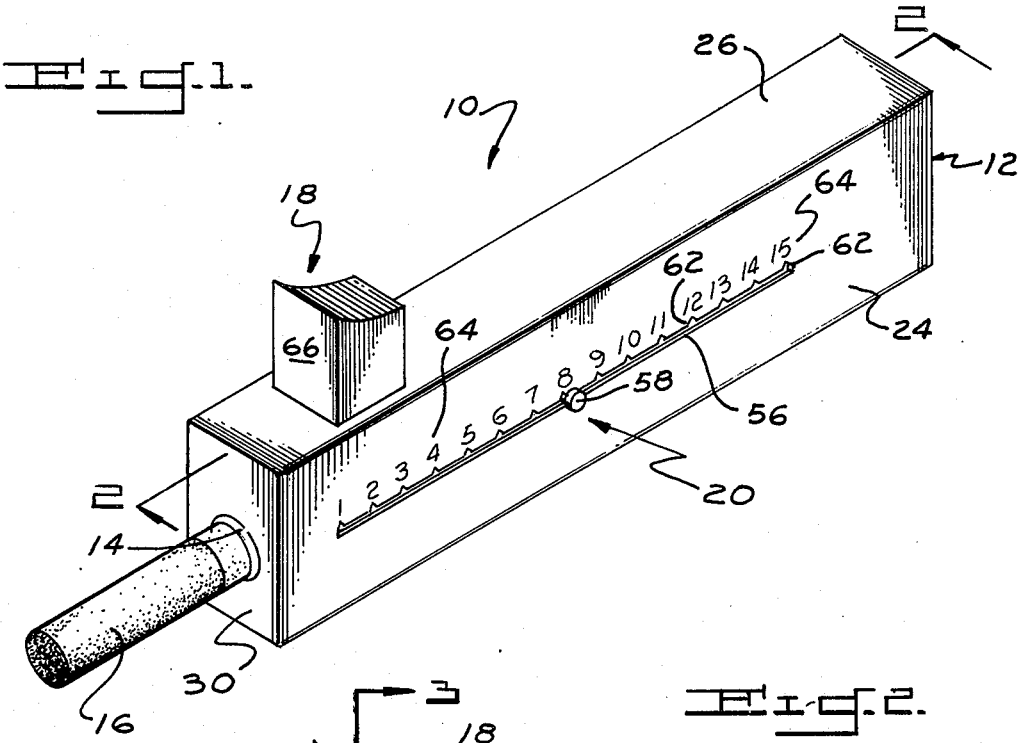
FIG. 1 is a perspective view of the cigarette or cigar severing apparatus of the present invention, showing a cigarette received therewithin.

Referring to the drawings, the apparatus of the present invention for severing predetermined lengths from a cigarette, cigar and the like is shown at 10 and generally comprises a casing 12 which includes in the interior thereof a tubular passage or means 14 for receiving a cigarette or cigar 16 to be cut, means 18 for cutting the cigarette or cigar and an adjustable stop means 20 which defines an end of passage 14 and varies the effective length of the passage and that portion of the cigarette or cigar to be severed from the main body thereof.

Casing 12 provides a suitable mount for the receiving means, cutting means and the adjustable stop means and also provides a means by which the apparatus may be conveniently manipulated in the use thereof. As shown, casing 12 comprises sidewalls 22 and 24, top and bottom walls 26 and 28, respectively, and end walls 30 and 32 joined to define a generally closed elongated rectangular compartment. The wall members may be formed of any suitable material such as a synthetic plastic and may be integrally molded or formed separately and bonded together.

Tubular passage 14 is supported within casing 10 on forward struts 34, 36, 38, and 40, rear struts 42 and 44 and end wall 30. The struts and the tubular passage 14 may be formed from plastic or the like and molded integrally with one or more adjacent wall members or formed separately therefrom and secured thereto as by known bonding means. As shown, passage 14 has an inside diameter slightly greater than the diameter of a standard size cigarette whereby the cigarette may be easily inserted into and withdrawn from the apparatus. However, it will be appreciated that tubular passage 14 may be dimensioned to accommodate cigarettes or cigars of any size.

Figure 2:
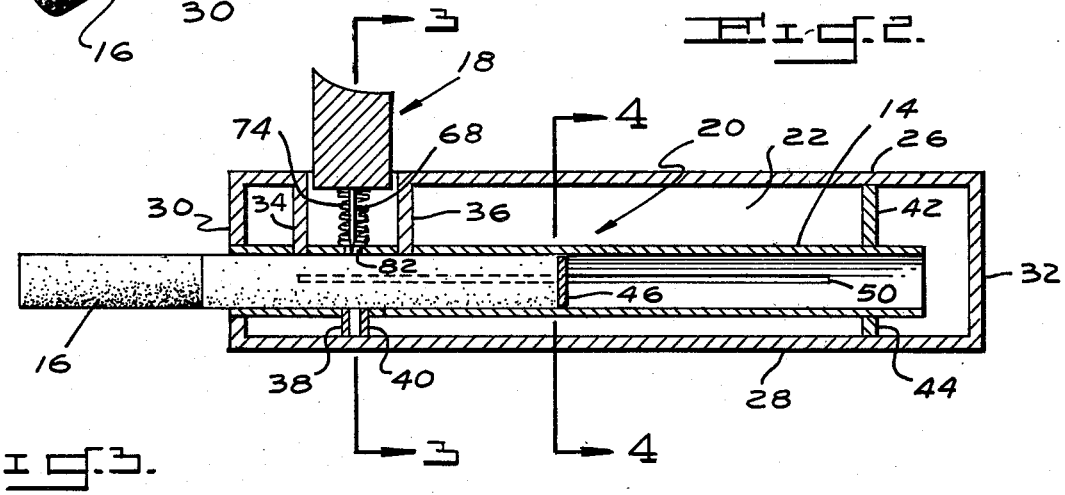
FIG. 2 is a sectional side view taken along line 2—2 of FIG. 1.
Figure 3:
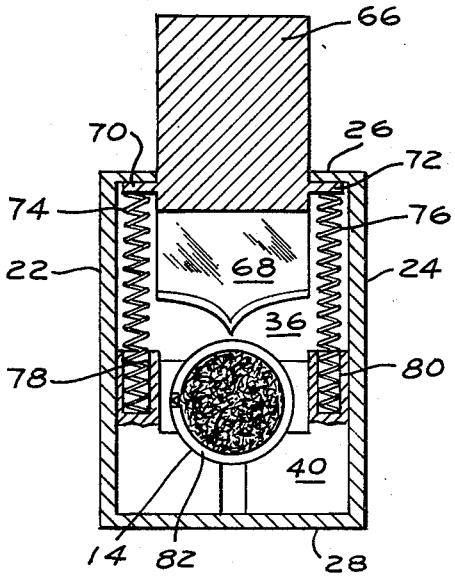
FIG. 3 is a sectional view taken along line 3—3 of FIG. 2.
Figure 4:
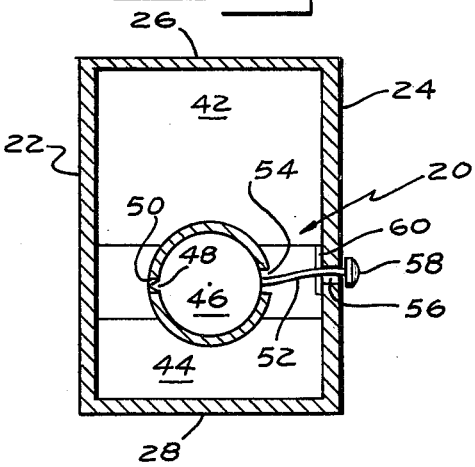
FIG. 4 is a sectional view taken along line 4—4 of FIG. 2.

As best seen in FIGS. 2 and 4, adjustable stop means 20 comprises a plug or passage end wall 46 which conforms to the interior of the tubular passage and is longitudinally positionable therealong. Referring particularly to FIG. 4, it will be noted that end wall 46 is provided with a guide 48 extending from an edge thereof and is slidably received within a groove or slot 50 provided in the tubular passage 14 for maintenance of the proper alignment of the end wall with the tubular passage. A spring arm 52 extends from an edge of end wall 46 generally opposite guide 48, through slots 54 and 56 in the tubular passage and casing, respectively, and terminates in an actuator button 58. As best seen in FIG. 4, when assembled with tubular passage 14 and casing 12, a slight bend is formed in spring arm 52 and is maintained therein by plate 60 fixed to the spring arm bearing against wall 24. This bend in the spring arm serves to urge wall 46 to the left as viewed in FIG. 4 and guide 48 into registry with slot 50 for maintaining the alignment of the end wall with the tubular passage. As best illustrated in FIG. 1, slot 56 is provided with detent notches 62 in one side thereof which may be labelled with indicia 64 which indicate the relative position of end wall 46. The bend in spring arm 52 further serves to maintain the spring arm in registry with the detent notches thereby preventing any undesired movement of the end wall along the tubular passage. As will be appreciated, the user may accurately position the cigarette or cigar to be trimmed relative to cutting means 18 by indexing end wall 46 through selective longitudinal movement of the spring arm along slot 56.

Cutting means 18 comprises an actuator button 66 received between struts 34 and 36 and having a blade 68 extending from the bottom thereof. The button is provided with extensions 70 and 72 which abut the underside of casing wall 26 for the retention of the blade within the casing. Blade 68 is biased out of the interior of tubular passage 14 by compression springs 74 and 76, respectively, which bear against extensions 70 and 72 and are received in wells 78 and 80 formed in struts 38 and 40. Depression of button 66 urges the blade through tubular passage 14 in slot 82 provided therein, for cutting a desired length from a cigarette or cigar inserted in the device.

When using the device, a smoker may begin a program of gradual reduction in tobacco consumption, by setting spring arm 52 into the notch labelled "1" in the drawings. In such position, only a small end portion of a cigarette inserted in the device is received within passage 14 and severed by an actuation of the cutting means. As the smoker progresses with the program, the spring arm is set into the notches labelled with progressively higher numerals such that when a cigarette or cigar is inserted into the device and cut, greater lengths of the cigarette or cigar will be severed therefrom.

What is claimed is:

1. A device for severing predetermined lengths from cigarettes, cigars and the like, said device comprising:

a tubular channel for receiving said cigarette or cigar, said tubular channel including a longitudinal slot therethrough along substantially the entire length thereof, and being grooved opposite said longitudinal slot, a blade for severing the end of said cigarette or cigar disposed in said tubular channel, said blade being movable laterally through said tubular channel and biased away from the interior of said tubular channel, stop means disposed within said tubular channel and adjustably positionable along substantially the entire length thereof whereby predetermined lengths of said cigarette or cigar may be positioned in said tubular channel for severing by said blade, said stop means comprising a plug conforming to the interior of said tubular channel, said plug including a guide extending from an edge thereof, said guide being slidably received within said groove for maintenance of the proper alignment of said plug with said tubular channel and indexing means, said indexing means comprising an arm extending from said plug and received within said longitudinal slot, said plug being adjustably positionable within said tubular channel by the longitudinal movement of said arm along said slot.

2. The device of claim 1 wherein the tubular channel is surrounded by a casing having a longitudinal slot with a plurality of detents spaced therealong, wherein said arm extends through said casing slot and engages said detents thereby restraining said arm and preventing accidental movement of said plug along the interior of said tubular channel.

3. The device of claim 2 wherein said detents comprise notches disposed along one side of said longitudinal slot and wherein said arm is formed from a resilient material, the inherent resilience of said arm maintains said arm in registry with said notches.

* * * * *